US006439985B2

(12) United States Patent
Rogers et al.

(10) Patent No.: US 6,439,985 B2
(45) Date of Patent: Aug. 27, 2002

(54) SANDING MACHINE CLAMP BAR

(75) Inventors: Mark G Rogers, Chesham; Christopher J Hedger, Bushey, both of (GB)

(73) Assignee: Hire Technicians Group, Ltd., Watford (GB)

( * ) Notice: Subject to any disclaimer, the term of this patent is extended or adjusted under 35 U.S.C. 154(b) by 0 days.

(21) Appl. No.: 09/821,292

(22) Filed: Mar. 28, 2001

(30) Foreign Application Priority Data

Apr. 1, 2000 (GB) ..... 0008038

(51) Int. Cl.[7] ..... B24B 41/00
(52) U.S. Cl. ..... 451/442; 451/501
(58) Field of Search ..... 451/442, 496, 451/497, 498, 499, 500, 501, 520, 522, 178

(56) References Cited

U.S. PATENT DOCUMENTS 10,152 A * 7/1853 Bridgman et al. ..... 451/501
1,162,098 A * 11/1915 Paszkiewicz ..... 451/522

FOREIGN PATENT DOCUMENTS

GB 0025234 * of 1905 ..... 451/496

* cited by examiner

*Primary Examiner*—Robert A. Rose
(74) *Attorney, Agent, or Firm*—Christie, Parker & Hale, LLP

(57) ABSTRACT

A paper clamp bar for a sanding machine comprises an elongate steel bar having two opposed major faces each defined by a concave helical surface. As a result the clamp bar can be fitted either way up to the drum of a sanding machine.

3 Claims, 2 Drawing Sheets

SANDING MACHINE CLAMP BAR

CROSS-REFERENCE TO RELATED APPLICATIONS

This application claims priority of United Kingdom patent application No. 0008038.2, filed Apr. 1, 2000.

BACKGROUND OF THE INVENTION

The invention relates to a clamp bar for a sanding machine.

Sanding machines using a rotating cylindrical sanding drum are well known. An abrasive paper sheet or a screen is wrapped around the drum and held in place by a clamp bar which locates in a recess formed in the cylindrical surface and clamps the ends of the paper.

In order to avoid chatter, the recess is not quite parallel to the axis of the drum but advances circumferentially by about 20° over its length. Because of this advance, the paper clamp bar must be formed to a helical shape to conform to the recess. In the prior art, the clamp bar is of constant thickness along its length and is very slightly concave from end to end on one side and very slightly convex on its other side. Thus, only the concave side can be correctly fitted to the drum and when this is worn out, due to abrasion between the drum and the bar during operation of the sanding machine, the clamp bar must be discarded. Because the concavity/convexity of the clamp bar is fairly slight, it is not uncommon for inexperienced operators to fit the clamp bar with the convex face against the drum instead of the concave face.

SUMMARY OF THE INVENTION

The present invention overcomes the disadvantages of the prior clamp bar by providing a clamp bar which has an identical concave surface on either side and can thus be fitted to the drum either way up.

Accordingly, the invention provides a paper clamp bar for a sanding machine, comprising an elongate bar having two opposed major faces each defined by a concave helical surface.

DETAILED DESCRIPTION OF THE PREFERRED EMBODIMENT

Figure 1:
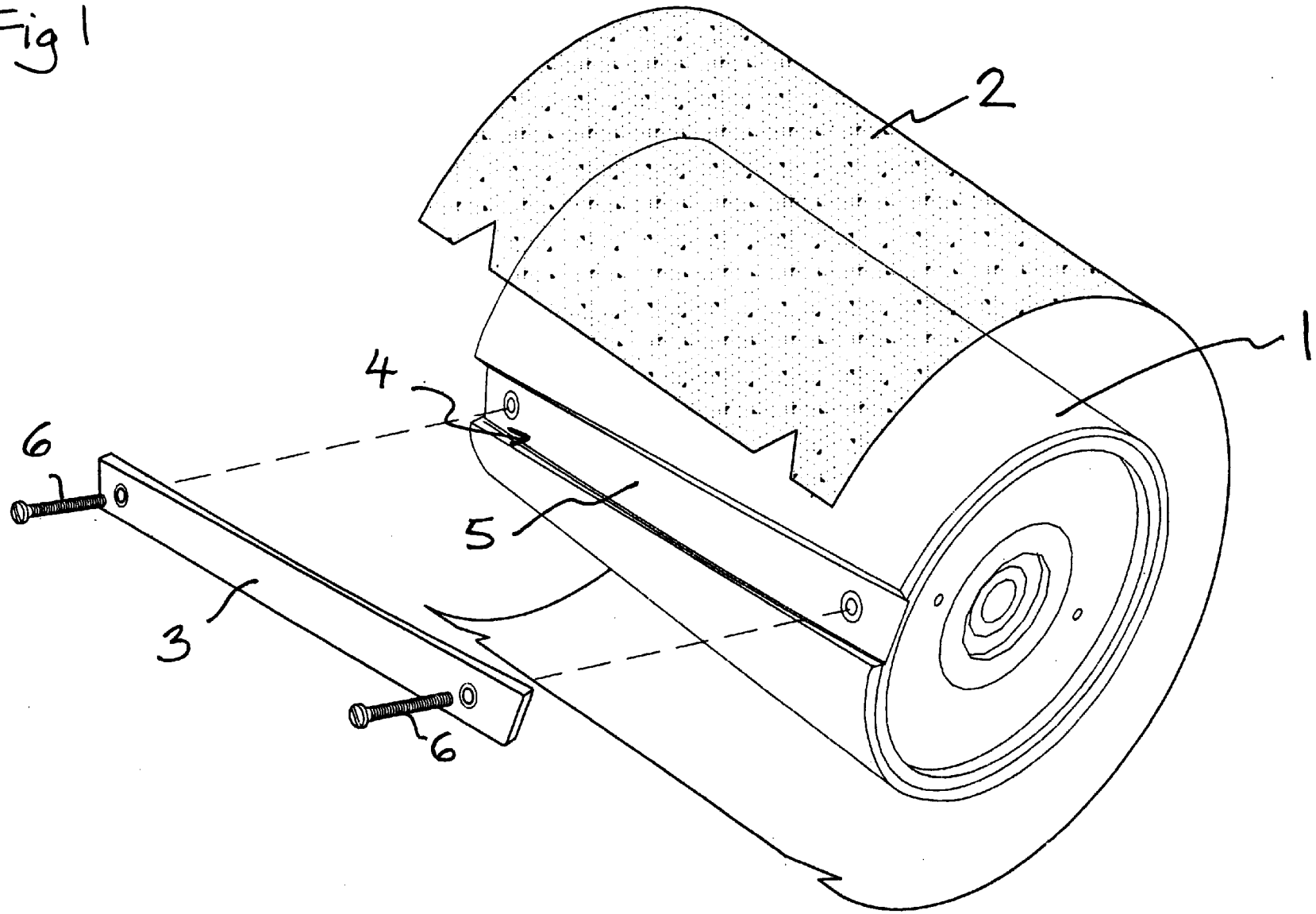
FIG. 1 is an exploded perspective view of sanding apparatus.
Figure 2:
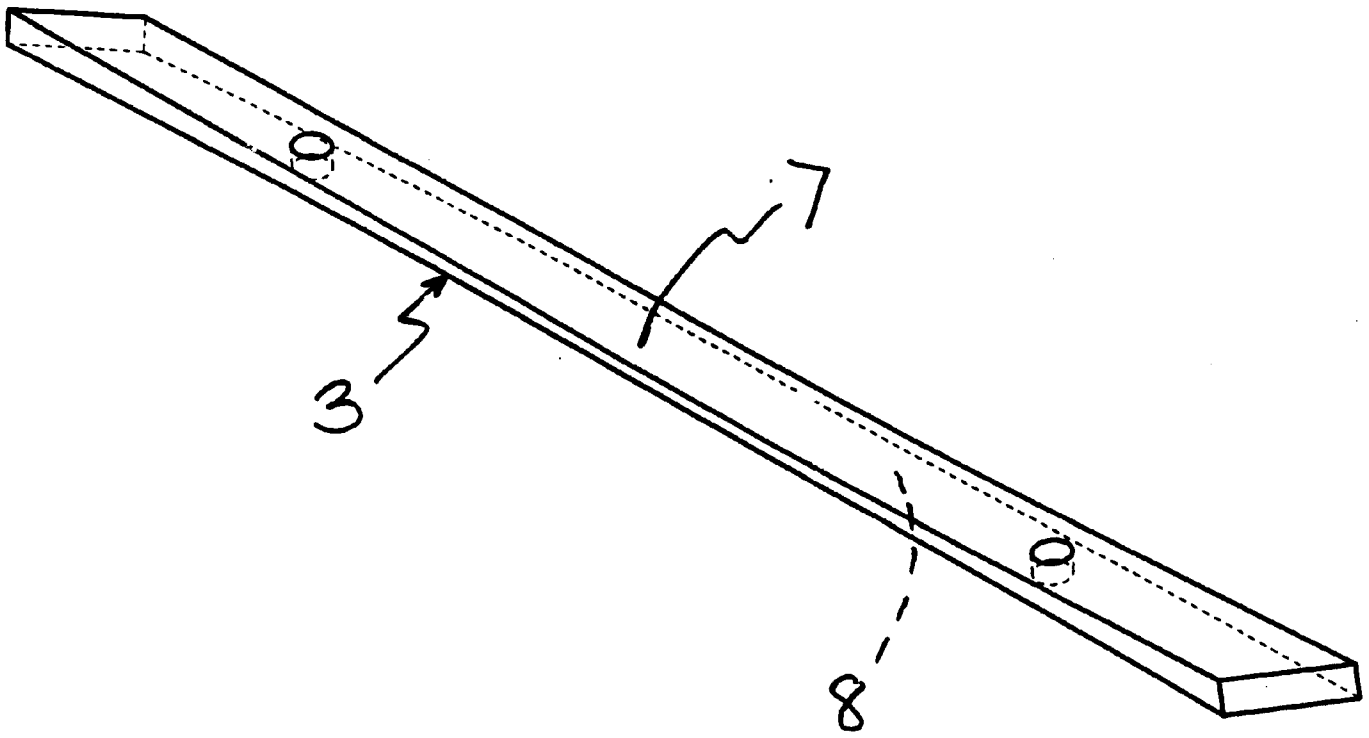
FIG. 2 is a perspective view of a clamp bar on a larger scale.

The sanding apparatus shown in FIG. 1 comprises a sanding drum 1, a sheet of sanding paper 2 and an elongate paper clamp bar 3. The drum 1 is formed with a helical recess 4 which advances circumferentially by about 20° over its length. Because of this advance, the bottom surface 5 of the recess is slightly convex from end to end.

The clamp bar may be held in place by any number of fixings. In the embodiment shown, the clamp bar 3 is held in place in the recess by a pair of screws 6.

The clamp bar has two opposed major faces 7 and 8 and each is defined by a helical surface which conforms to the bottom surface of the recess 5 and is slightly concave from end to end.

As can be seen, this results in the bar having a thickness along its length which reduces towards its middle and increases towards its ends. The cross section of the bar at any point along its length is rectangular.

The bar is made of metal and preferably is made from tool steel in a drop-forging operation.

What is claimed is:

1. A clamp bar for a sanding machine, comprising an elongate bar having two opposed major faces each defined by a concave helical surface.

2. A clamp bar as claimed in claim 1, wherein the cross-section of the bar at any point along its length is rectangular.

3. A clamp bar as claimed in claim 1, made of drop-forged stool steel.

* * * * *

UNITED STATES PATENT AND TRADEMARK OFFICE

CERTIFICATE OF CORRECTION

PATENT NO. : 6,439,985 B2 
DATED : August 27, 2002
INVENTOR(S) : Mark G. Rogers and Christopher J. Hedger It is certified that error appears in the above-identified patent and that said Letters Patent is hereby corrected as shown below:

Column 2,
Line 39, delete “stool”, and replace with -- tool --

Signed and Sealed this

Sixth Day of May, 2003

JAMES E. ROGAN
*Director of the United States Patent and Trademark Office*